US006641510B2

(12) United States Patent
Koenig

(10) Patent No.: US 6,641,510 B2
(45) Date of Patent: Nov. 4, 2003

(54) SPRING ASSISTED SPOTTER PINS FOR A WEIGHT LIFTING POWER RACK

(76) Inventor: Larry Koenig, P.O. Box 1037, Williamsburg, IA (US) 52361

( * ) Notice: Subject to any disclaimer, the term of this patent is extended or adjusted under 35 U.S.C. 154(b) by 127 days.

(21) Appl. No.: 09/819,665

(22) Filed: Mar. 29, 2001

(65) Prior Publication Data

US 2002/0142893 A1 Oct. 3, 2002

(51) Int. Cl.[7] ..... A63B 21/078; A63B 21/06
(52) U.S. Cl. ..... 482/104; 482/94
(58) Field of Search ..... 482/104, 106, 482/108, 44, 47–49, 93–94

(56) References Cited

U.S. PATENT DOCUMENTS 4,226,412 A * 10/1980 Panepinto ..... 482/49
4,332,380 A * 6/1982 Cardin ..... 482/126
5,011,141 A 4/1991 Towley, III et al.
5,078,388 A * 1/1992 Dempsey, Jr. ..... 482/49
5,141,480 A 8/1992 Lennox et al.
5,281,193 A 1/1994 Colbo, Jr. et al.
5,399,133 A * 3/1995 Haber et al. ..... 482/49
5,514,058 A * 5/1996 Buoni et al. ..... 482/124
5,556,359 A * 9/1996 Clementi ..... 482/49
5,720,700 A * 2/1998 Buoni et al. ..... 482/124
5,823,921 A 10/1998 Dawson
5,989,166 A 11/1999 Capizzo et al.
6,086,520 A 7/2000 Rodriquez
6,099,438 A * 8/2000 Dawson ..... 482/47
6,398,694 B1 * 6/2002 Bountourakis ..... 482/44

* cited by examiner

*Primary Examiner*—Jerome W. Donnelly
*Assistant Examiner*—Fenn Mathew
(74) *Attorney, Agent, or Firm*—Siemens Patent Services, LC

(57) ABSTRACT

There is provided a unique weight lifting spotting pin which provides an assist to the weight lifter to speed the development of his lifting ability. The inventive spotter pins mount to typical weight lifting power rack to provide a rest for a weight bar. A helical spring forms the weight bearing element of the spotter pin, flexing downwardly under the weight of the resting weight bar. As a lifter begins to lift the weight bar, the helical spring tends to return to its natural, unflexed position, thereby helping to snap the weight bar upwardly from the spotter pin. With an assist in initiating the lift, a weight lifter may more rapidly increase his lift weight, thereby speeding the training time required to achieve a desired weight lift.

6 Claims, 3 Drawing Sheets

SPRING ASSISTED SPOTTER PINS FOR A WEIGHT LIFTING POWER RACK

BACKGROUND OF THE INVENTION

1. Field of the Invention

The present invention relates to physical training equipment, especially as it relates to weight lifting. More particularly, the invention comprises a spring assisted spotter pin for a weight lifting power rack which allows a lifter to increase the load of a weight bar without risk of being pinned by the bar.

2. Description of the Prior Art

Weight lifters routinely use a power rack to support their weight bar such that the bar can be lifted from either a prone or a standing position. The power rack has spotter pins which hold the weight bar prior to and after a lift and also acts as a stop to prevent the weights from falling onto the lifter. Typically these spotter pins are mounted horizontally from the vertical members of the power rack by a series of mounting holes in the power rack legs.

U.S. Pat. No. 6,086,520, issued to Anibal Rodriquez on Jul. 11, 2000, presents a WEIGHT LIFTING SAFETY SYSTEM EMPLOYING CONSTANT FORCE SPRING, wherein an elliptical spring and an electrically driven jackscrew situated on each side of a weight lifting bench provides an emergency lifting device, activated by a foot switch, in the event the lifter become pinned by the weight bar. The present invention provides no active lifting for emergency situations, but rather provides a passive protection against pinning while providing a spring assisted lift for training.

U.S. Pat. No. 5,989,166,issued to Kevin Capizzo, et. al., on Nov. 23, 1999 , presents an ADJUSTABLE BARBELL PRESS APPARATUS, and U.S. Pat. No. 5,823,921,issued to Jeffrey S. Dawson on Oct. 20, 1998 presents a FREE-WEIGHT BARBELL LIFTING EXERCISE MACHINE WITH USER CONTROLLABLE LIFT ASSIST AND SAFETY DEVICE, wherein a framework rising above a weight bench supports an electric winch or other similar lifting device to assist the lifter in the lift process or to aid in maintaining control of the weight bar after exerting himself to muscle exhaustion. Conversely, the present invention uses no electrical means to control the weight bar, relying instead on a spring to provide lift assist and a rigid bar to protect against dropping of the weight bar upon muscle exhaustion.

U.S. Pat. No. 5,281,193,issued to Kenneth G. Colbo, Jr., on Jan. 25, 1994 , presents a BENCH-PRESS WEIGHT WORKOUT STATION WITH SMART FEATURES; U.S. Pat. No. 5,141,480,issued to James J. Lennox, et. al., on Aug. 25, 1992 , presents a BENCH PRESS EXERCISE APPARATUS; and U.S. Pat. No. 5,011,141,issued to Carl K. Towley, III, et. al., on Apr. 30, 1991 presents a BENCH PRESS WITH ADJUSTABLE SAFETY/RANGE LIMITING BARS, wherein spotter pins or limiting bars mounted to the vertical frame of a power rack provide a stopping bar to prevent the weight lifter from being pinned by the weight bar after muscle exhaustion and provides a shelf for resting the weight bar on in preparation for and after a lift. The present invention also provides spotter pins for protecting the weight lifter, but also provides a spring assist in the lifting process, which is lacking in Colbo; Lennox, et. al.; and Towley, III, et. al.

None of the above inventions and patents, taken either singly or in combination, is seen to describe the instant invention as claimed.

SUMMARY OF THE INVENTION

In weight training, a lifter typically uses a power rack having spotter pins to support his weights prior to and after a lift. The spotter pins also provide assurance that the weights will not drop and pin him in the event he should loose control of the weights. These spotter pins are typically rigid bars adjustably mounted horizontally from the vertical members of the power rack through a series of adjustment holes in the vertical legs of the rack.

The present invention provides a spotter pin which not only provides the support for the weight bar and protection from dropped weights, but also provides lifting assist for improved training. Rather than being a rigid bar, as is typical in the prior art, the present invention includes a helical spring encased in a vinyl cover which flexes downwardly when the weight bar is placed on it, providing the lifter a degree of assistance in initiating a lift, thereby accelerating training. For mounting purposes and added safety, the present invention also incorporates a rigid brace below the spring.

Accordingly, it is a principal object of the invention to provide a weight lifting spotter pin which is economical.

It is another object of the invention to provide a weight lifting spotter pin which is easy to install.

It is a further object of the invention to provide a weight lifting spotter pin which is safe to use.

Still another object of the invention is to provide a weight lifting spotter pin which provides assistance in initiating a lift.

An additional object of the invention is to provide a weight lifting spotter pin which allows a lifter to increase his lift weight more rapidly.

It is again an object of the invention to provide a weight lifting spotter pin which provides a dampened stop a the end of a lift.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Spotter pins, mounted horizontally to the vertical members of a power frame, have long been used as a safety device for weight lifters, providing a place to rest the weights prior to and after a lift and protection from a weight bar falling and pinning the lifter. The present invention adds a spring assist to the lifter, greatly accelerating training time.

Figure 1:
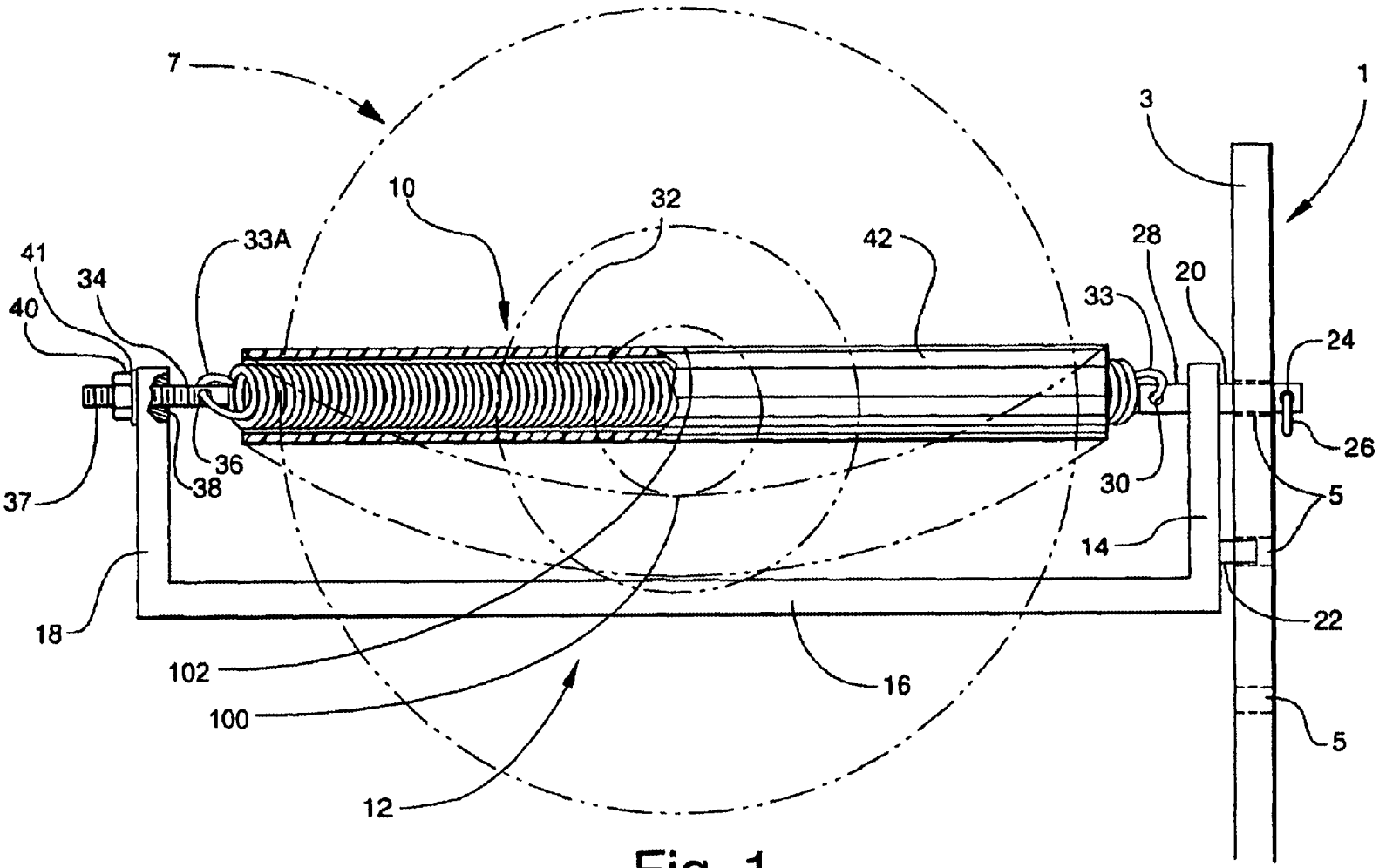
FIG. 1 is a side view of a single one of the pair of the inventive spotter pins as mounted on one of the vertical elements of a power rack.
Figure 2:
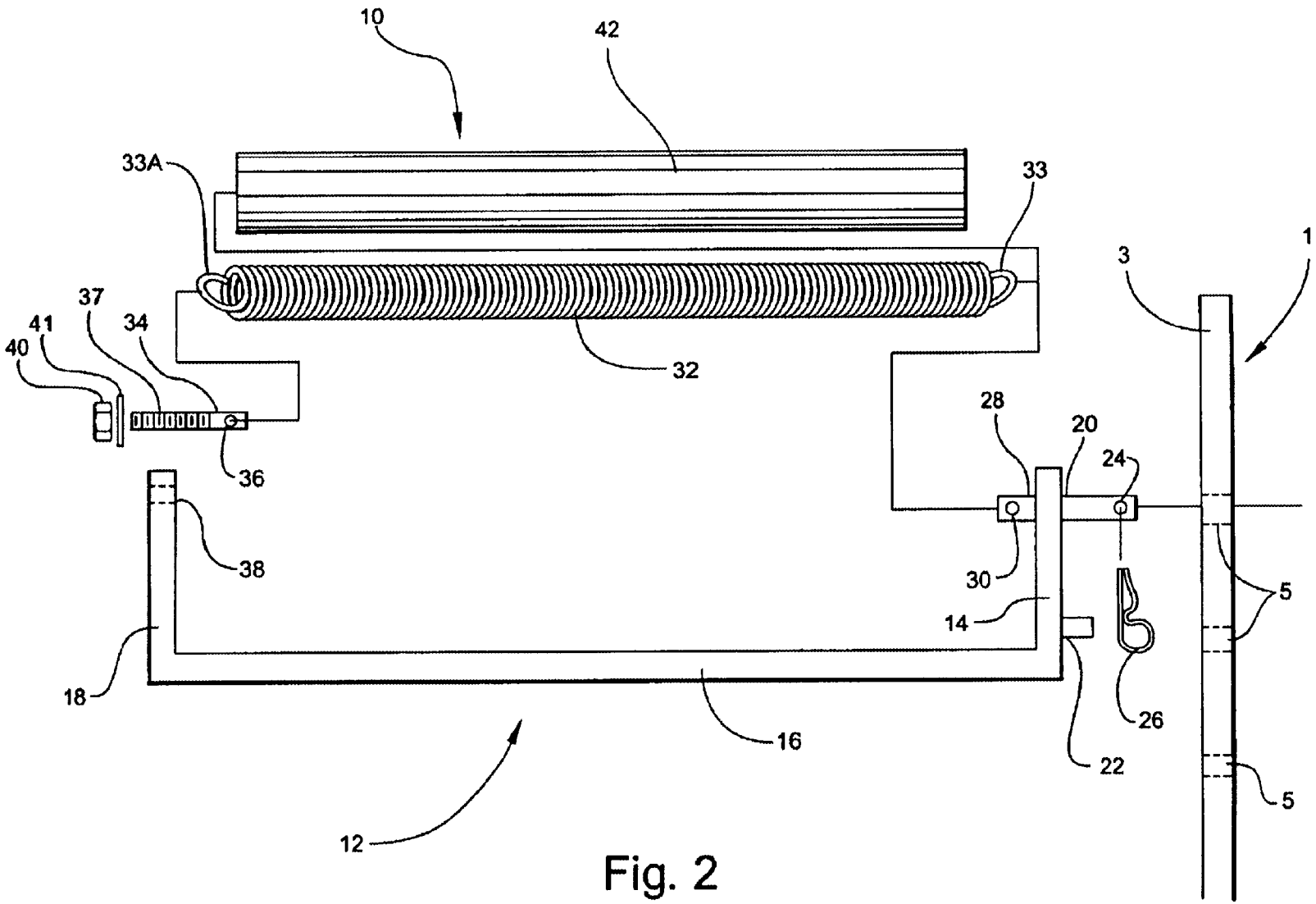
FIG. 2 is an exploded side view of the invention.

Referring now to FIG. 1 and FIG. 2, the inventive spotter pin 10 is mounted to a vertical member 3 of a power rack 1. The primary structure of spotter pin 10 is a "U" bracket 12, having a suspension end 14, a lower, horizontal arm 16, and a free end 18. A mounting pin 20 rigidly affixed at a first end proximate the upper extreme of the outer surface (as it relates to the noted "U" shape of bracket 12) of suspension end 14 and a locking pin 22 affixed at a first end proximate the lower extreme of the outer surface of suspension end 14 mount spotter pin 10 to vertical member 3 of power rack 1 through mounting apertures 5 in vertical member 3. Retaining pin aperture 24, proximate a second end of mounting pin 20, receives retaining pin 26 (any of a variety of available retaining pins) to secure mounting pin 20 in aperture 5.

Spring arm 28 is affixed at a first end proximate the upper extreme of the inner surface of suspension end 14, substantially opposite mounting pin 20. Spring arm aperture 30, proximate a second end of spring arm 28 receives spring hook 33 at a first end of helical spring 32. A spring rod 34, having a spring hook aperture 36 at a first end and threads 37 at a second end passes through a spring rod aperture 38 proximate the upper extreme of free end 18 of "U" bracket 12. Spring hook 33A at a second end of spring 32 engages with spring hook aperture 36 in spring rod 34, while spring rod tensioning nut 40 engages the threads 37 at the second end of spring rod 34. Tension of spring 32 is adjusted by tightening or loosening spring rod tensioning nut 40 against free end 18 of "U" bracket 12. A tensioning washer 41 is fitted over spring rod 34 between free end 18 and spring rod tensioning nut 40. Helical spring 32 is encased in a semi-rigid plastic covering 42 (FIG. 2) to provide protection against damage to the helical spring 32 and items coming in contact with helical spring 32, such as a weight bar or the weight lifters finger (not shown).

Figure 3:
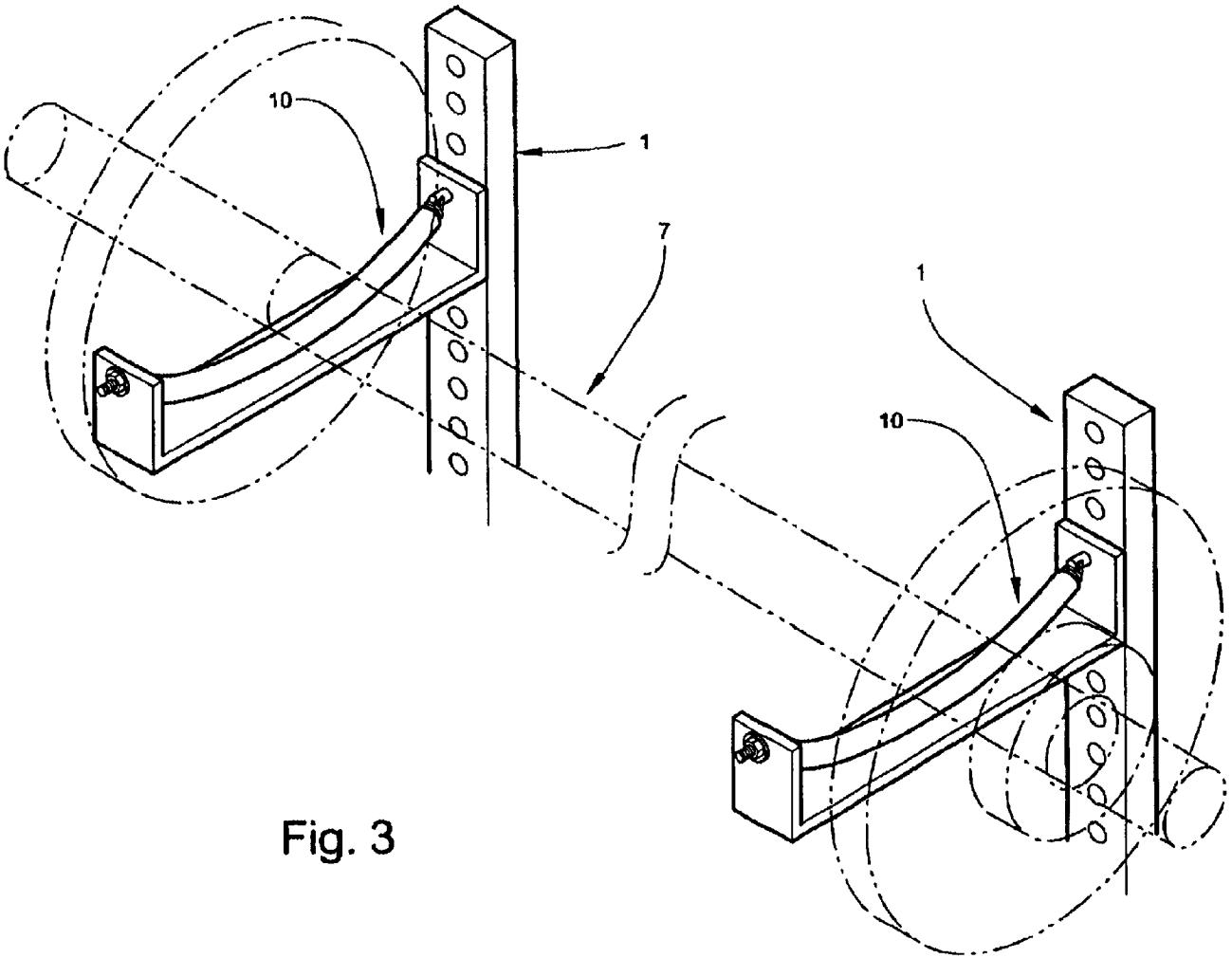
FIG. 3 is an environmental perspective of the invention with a weight bar at rest on the inventive spotter pins.

Referring now also to FIG. 3, in use, one of the inventive spotter pins 10 is mounted to each of the two vertical members 3 of a power rack 1 by inserting mounting pin 20 into a first mounting aperture 5 in vertical member 3 and locking pin 22 into a second, lower mounting aperture 5. A retaining pin 26 is fit through retaining pin aperture 24 of mounting pin 20 to prevent mounting pin 20 from withdrawing from mounting aperture 5. A weight bar 7 is placed so that the helical spring 32 of each of the spotter pins 10 supports one of the two ends of the weight bar 7. With weight bar 7 so placed, helical springs 32 flexes downward, to a first position 100, under the weight of weight bar 7. A weight lifter (not shown), either prone or standing, positions himself under weight bar 7 and lifts the weight bar 7 as he would with a conventional spotter pin. Due to the downward flex of helical springs 32 and the tendency for helical springs 32 to return to the natural, unflexed position 102, as the weight lifter lifts weight bar 7 from spotter pins 5, helical springs 32 add an assist to the lifter. Since most of the exertion is weight lifting is in gaining the initial momentum of the lift, this assist allows a lifter to lift a little extra weight than he would be able to without the assist provided by helical springs 32. Therefore, a lifter in training can increase the weight of weight bar 7 more rapidly than with standard, rigid spotter pins.

It would be evident to one skilled in the art that spotter pins 10 could be of a variety of materials, such as, but not limited to steel, aluminum, or polycarbons.

It is to be understood that the present invention is not limited to the embodiments described above, but encompasses any and all embodiments within the scope of the following claims.

What is claimed is:

1.A spring assisted weight lifting spotter pin assembly adapted for use with a weight lifting power rack, said spotter pin assembly comprising:

1) a contiguous, substantially U-shaped spotter spin, said spotter pin having at least three rigid walls comprising:
a lower horizontal arm having two adjoining vertical walls on either end,
said two adjoining vertical walls each having a proximal end and a distal end;

2) spring means laterally extending along a horizontal plane parallel with said lower horizontal arm of said spotter pin,
said spring means adapted and configured to provide horizontal tension forces, said horizontal tension forces providing an added assist resulting in vertical forces when a tangential force is applied thereupon by weights; and 3) a first and second spring coupling means for coupling spring means to both said adjoining vertical walls, both said first and second spring coupling means having a first and second end, and wherein the distal end of at least one of said adjoining vertical walls has mounting means for mounting to a weight lifting rack, wherein each of said two adjoining vertical walls extend at substantially right angles at their distal ends relative to said lower horizontal arm;

wherein both said first ends of said spring coupling means has spring connector means for directly coupling each end of said spring means to each of said first and second spring coupling means, said proximal ends having a first fastening means for providing attachment to a spring means.

2. The spring assisted weight lifting spotter pin assembly as recited in claim 1 wherein, said first spring coupling means has threads on said second end and an accompanying nut, said threads and accompanying nut allowing for adjustment of the tension of said spring means, said second spring coupling means has a retaining means on said second end for securing said second end to a weight lifting power rack; and wherein said distal mounting means is a protruding notch for matingly engaging mounting apertures within a weight lifting rack.

3. The spring assisted weight lifting spotter pin as recited in claim 2, wherein said spring means comprises a helical spring.

4. The spring assisted weight lifting spotter pin as recited in claim 3, wherein said helical spring is formed of a rigid material and is encased in a semi-rigid covering.

5. A spring assisted weight lifting spotter pin assembly adapted for use with a weight lifting power rack, said spotter pin assembly comprising:

1) a contiguous, substantially U-shaped spotter spin, said spotter pin having at least three rigid walls comprising:
a lower horizontal arm having two adjoining vertical walls on either end,
said two adjoining vertical walls each having a proximal end and a distal end;

2) spring means laterally extending along a horizontal plane parallel with said lower horizontal arm of said spotter pin, said spring means adapted and configured to provide horizontal tension forces, said horizontal tension forces providing an added assist resulting in vertical forces when a tangential force is applied thereupon by weights; and 3) a first and second spring coupling means for coupling spring means to both said adjoining vertical walls, both said first and second spring coupling means having a first and second end, and wherein the distal end of at least one of said adjoining vertical walls has mounting means for mounting to a weight lifting rack, wherein each of said two adjoining vertical walls extend at substantially right angles at their distal ends relative to said lower horizontal arm;

wherein both said first ends of said spring coupling means has spring connector means for directly coupling each end of said spring means to each of said first and second spring coupling means, said proximal ends having a first fastening means for providing attachment to a spring means;

said first spring coupling means has threads on said second end and an accompanying nut, said threads and accompanying nut allowing for adjustment of the tension of said spring means, said second spring coupling means has a retaining means on said second end for securing said second end to a weight lifting power rack; and wherein said distal mounting means is a protruding notch for matingly engaging mounting apertures within a weight lifting rack.

6. A method for lifting a weight bar, in combination with two spring assisted weight lifting spotter pins adapted for use with a weight lifting power rack, said method step comprising:

a) providing two spring assisted weight lifting spotter pins as in claim 5;

b) providing at least two weight lifting power rack having a series of mounting apertures;

c) mounting one of said spring assisted weight lifting spotters to the weight lifting power rack by matingly engaging said protruding notch in a mounting aperture within said weight lifting power rack, and by securing said retaining means in another mounting aperture;

d) adjusting the tension of said spring means by rotating said nut relative to said threads, said spring means thus being in a first, unflexed position;

e) placing a weight bar on said two spring assisted spotting pins such that one end of said weight bar rests on each of said two spotting pins, the weight of said weight bar causing said spring means to flex downwardly to a second, flexed position;

f) positioning a weight lifter under said weight bar, said weight lifter lifting said weight bar resulting in said downward flex of said spring means providing an assist in vertical forces to said weight lifter in lifting said weight bar by said spring means returning to said first, unflexed position as the weight of said weight bar is removed from said spring means, thereby allowing said weight lifter to lift a greater weight, thus allowing the lifter to increase lifting capacity more rapidly.

* * * * *